US012247482B2

(12) United States Patent
Sosareyes

(10) Patent No.: US 12,247,482 B2
(45) Date of Patent: Mar. 11, 2025

(54) WELLBORE DOWNLINK COMMUNICATION

(71) Applicant: Halliburton Energy Services, Inc., Houston, TX (US)

(72) Inventor: Cristian Lenin Sosareyes, Stafford, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/185,835

(22) Filed: Mar. 17, 2023

(65) Prior Publication Data

US 2024/0309755 A1 Sep. 19, 2024

(51) Int. Cl.
*E21B 47/18* (2012.01)
*E21B 47/12* (2012.01)
*E21B 47/125* (2012.01)

(52) U.S. Cl.
CPC ..... *E21B 47/125* (2020.05); *E21B 47/18* (2013.01)

(58) Field of Classification Search
None
See application file for complete search history.

(56) References Cited

U.S. PATENT DOCUMENTS 2,700,131 A 1/1955 Otis et al.
3,427,580 A 2/1969 Brock
3,464,058 A 8/1969 Gollwitzer
3,789,355 A 1/1974 Patton
3,820,063 A 6/1974 Sexton et al.
3,822,589 A 7/1974 Le et al.
4,167,000 A 9/1979 Bernard et al.
4,351,037 A 9/1982 Scherbatskoy
4,390,975 A 6/1983 Shawhan
4,675,852 A 6/1987 Russell et al.
4,694,439 A 9/1987 Moll
4,698,794 A 10/1987 Kruger et al.
4,763,258 A 8/1988 Engelder
4,774,694 A 9/1988 Moll
4,787,093 A 11/1988 Rorden
5,034,929 A 7/1991 Cobern et al.
(Continued)

FOREIGN PATENT DOCUMENTS

CA 3114612 A1 * 4/2020 ..... E21B 47/12
CN 102644458 B * 10/2014
(Continued)

OTHER PUBLICATIONS

CN-106609668-A English Language Translation (Year: 2017).*
(Continued)

*Primary Examiner* — Curtis A Kuntz
*Assistant Examiner* — Jerold B Murphy
(74) *Attorney, Agent, or Firm* — Kilpatrick Townsend & Stockton LLP

(57) ABSTRACT

A computer-implemented method includes receiving sensor signals from at least one sensor at a bottom hole assembly within a wellbore. The method further includes identifying at least two downlink signal triggers from the sensor signals and detecting a downlink signal between the at least two downlink signal triggers. Further, the method includes decoding the downlink signal detected between the at least two downlink signal triggers and controlling a downhole tool using the decoded downlink signal.

20 Claims, 10 Drawing Sheets

(56) References Cited

U.S. PATENT DOCUMENTS

| | | | |
|---|---|---|---|
| 5,146,433 | A | 9/1992 | Kosmala et al. |
| 5,586,083 | A | 12/1996 | Chin et al. |
| 5,663,929 | A | 9/1997 | Pavone et al. |
| 5,679,894 | A | 10/1997 | Kruger et al. |
| 5,833,003 | A | 11/1998 | Longbottom et al. |
| 5,842,149 | A | 11/1998 | Harrell et al. |
| 5,963,138 | A | 10/1999 | Gruenhagen |
| 6,089,332 | A | 7/2000 | Barr et al. |
| 6,097,310 | A | 8/2000 | Harrell et al. |
| 6,105,690 | A | 8/2000 | Biglin, Jr. et al. |
| 6,116,354 | A | 9/2000 | Buytaert |
| 6,233,524 | B1 | 5/2001 | Harrell et al. |
| 6,244,361 | B1 | 6/2001 | Comeau et al. |
| 6,267,185 | B1 | 7/2001 | Mougel et al. |
| 6,400,646 | B1 | 6/2002 | Shah et al. |
| 6,608,565 | B1 | 8/2003 | Van et al. |
| 6,675,101 | B1 | 1/2004 | Shray et al. |
| RE38,567 | E | 8/2004 | Gruenhagen |
| 6,920,085 | B2 | 7/2005 | Finke et al. |
| 6,963,290 | B2 | 11/2005 | Marsh et al. |
| 7,082,821 | B2 | 8/2006 | Chen et al. |
| 7,222,681 | B2 | 5/2007 | Jones et al. |
| 7,245,229 | B2 | 7/2007 | Baron et al. |
| 7,320,370 | B2 | 1/2008 | Virally et al. |
| 7,480,207 | B2 | 1/2009 | Marsh et al. |
| 7,518,950 | B2 | 4/2009 | Treviranus et al. |
| 7,540,337 | B2 | 6/2009 | Mcloughlin et al. |
| 7,646,310 | B2 | 1/2010 | Close |
| 7,881,155 | B2 | 2/2011 | Close |
| 7,911,879 | B2 | 3/2011 | Jogi et al. |
| 7,928,861 | B2 | 4/2011 | Camwell et al. |
| 7,983,113 | B2 | 7/2011 | Krueger et al. |
| 8,319,657 | B2 | 11/2012 | Godager |
| 8,350,715 | B2 | 1/2013 | Shearer |
| 8,467,268 | B2 | 6/2013 | Close |
| 8,730,764 | B2 | 5/2014 | Tang et al. |
| 8,823,543 | B2 | 9/2014 | Camwell et al. |
| 8,824,241 | B2 | 9/2014 | Close et al. |
| 8,878,688 | B2 | 11/2014 | Miszewski |
| 8,880,349 | B2 | 11/2014 | Pillai et al. |
| 8,942,330 | B2 | 1/2015 | Moghaddamnia et al. |
| 9,105,836 | B2 | 8/2015 | Matam et al. |
| 9,488,045 | B2 | 11/2016 | Clausen et al. |
| 9,523,273 | B2 | 12/2016 | Mandal |
| 9,556,727 | B2 | 1/2017 | Saulnier et al. |
| 9,598,955 | B2 | 3/2017 | Gajji et al. |
| 9,625,603 | B2 | 4/2017 | Stolpman et al. |
| 9,749,717 | B2 | 8/2017 | White et al. |
| 9,759,062 | B2 | 9/2017 | Deffenbaugh et al. |
| 9,778,389 | B2 | 10/2017 | Stolpman |
| 9,784,097 | B2 | 10/2017 | Dugas |
| 9,797,242 | B2 | 10/2017 | Tang et al. |
| 9,850,754 | B1 | 12/2017 | Jiang et al. |
| 9,963,936 | B2 | 5/2018 | Kruspe et al. |
| 9,963,965 | B2 | 5/2018 | Saed |
| 9,976,406 | B2 | 5/2018 | Lautzenhiser et al. |
| 10,030,511 | B2 | 7/2018 | Ahmad et al. |
| 10,030,512 | B2 | 7/2018 | Ahmad et al. |
| 10,070,204 | B2 | 9/2018 | White et al. |
| 10,070,205 | B2 | 9/2018 | White et al. |
| 10,077,653 | B2 | 9/2018 | Hernandez et al. |
| 10,082,022 | B2 | 9/2018 | Brown-kerr et al. |
| 10,125,558 | B2 | 11/2018 | Sun et al. |
| 10,167,717 | B2 | 1/2019 | Disko et al. |
| 10,174,611 | B2 | 1/2019 | Stolpman |
| 10,246,994 | B2 | 4/2019 | Jaffrey |
| 10,287,852 | B2 | 5/2019 | Purkis et al. |
| 10,294,780 | B2 | 5/2019 | Barak |
| 10,329,897 | B2 | 6/2019 | Kona et al. |
| 10,329,902 | B2 | 6/2019 | Ahmad et al. |
| 10,349,151 | B2 | 7/2019 | White et al. |
| 10,352,157 | B2 | 7/2019 | Hernandez et al. |
| 10,378,342 | B2 | 8/2019 | Barak |
| 10,378,343 | B2 | 8/2019 | Ahmad et al. |
| 10,404,383 | B2 | 9/2019 | Ringgenberg |
| 10,419,018 | B2 | 9/2019 | Sun et al. |
| 10,472,957 | B2 | 11/2019 | Ahmad et al. |
| 10,480,308 | B2 | 11/2019 | Morrow et al. |
| 10,487,648 | B2 | 11/2019 | Ahmad et al. |
| 10,570,683 | B2 | 2/2020 | Boone |
| 10,590,760 | B2 | 3/2020 | Popp et al. |
| 10,597,960 | B2 | 3/2020 | Solem |
| 10,619,479 | B2 | 4/2020 | Zhang et al. |
| 10,738,598 | B2 | 8/2020 | Han et al. |
| 10,753,177 | B2 | 8/2020 | Purkis et al. |
| 10,760,408 | B2 | 9/2020 | Adetola et al. |
| 11,255,187 | B1 | 2/2022 | Chen et al. |
| 11,268,378 | B2 | 3/2022 | Zhang et al. |
| 11,280,183 | B2 | 3/2022 | Walton et al. |
| 11,371,343 | B2 | 6/2022 | Greci et al. |
| 2002/0185273 | A1 | 12/2002 | Aronstam et al. |
| 2003/0016164 | A1* | 1/2003 | Finke ..... E21B 47/22 340/854.3 |
| 2004/0200639 | A1 | 10/2004 | Jungerink |
| 2004/0217879 | A1 | 11/2004 | Guggari et al. |
| 2005/0001737 | A1* | 1/2005 | Baron ..... G01V 11/002 340/854.4 |
| 2005/0060096 | A1 | 3/2005 | Hutchinson |
| 2005/0209782 | A1 | 9/2005 | Moriarty |
| 2006/0215491 | A1 | 9/2006 | Hall |
| 2008/0204270 | A1 | 8/2008 | Aiello et al. |
| 2009/0044937 | A1 | 2/2009 | Purkis |
| 2011/0286308 | A1 | 11/2011 | Sugiura |
| 2017/0254195 | A1 | 9/2017 | Knight |
| 2017/0342823 | A1 | 11/2017 | Shah et al. |
| 2020/0347700 | A1 | 11/2020 | Yu |
| 2020/0386096 | A1* | 12/2020 | Sugiura ..... H04L 67/12 |
| 2021/0062644 | A1 | 3/2021 | Macpherson |
| 2021/0156246 | A1 | 5/2021 | Macpherson et al. |
| 2021/0180448 | A1 | 6/2021 | Annenkov et al. |
| 2021/0222550 | A1 | 7/2021 | Fripp et al. |
| 2021/0356617 | A1 | 11/2021 | Wilson et al. |
| 2022/0018239 | A1 | 1/2022 | Dunbar et al. |
| 2022/0106874 | A1 | 4/2022 | Lie et al. |
| 2022/0195862 | A1 | 6/2022 | Chen |
| 2022/0205358 | A1 | 6/2022 | Werkheiser et al. |
| 2022/0235650 | A1 | 7/2022 | Zhang et al. |

FOREIGN PATENT DOCUMENTS

| | | | | |
|---|---|---|---|---|
| CN | 106609668 | A | * | 5/2017 |
| CN | 109751043 | A | * | 5/2019 |
| CN | 110761776 | A | | 2/2020 |
| CN | 110792429 | A | | 2/2020 |
| CN | 111075437 | A | | 4/2020 |
| CN | 110513103 | B | | 5/2020 |
| CN | 110185422 | B | | 4/2022 |
| EP | 0819822 | A2 | | 1/1998 |
| FR | 1538144 | A | | 8/1968 |
| GB | 1385740 | A | | 2/1975 |
| GB | 2156878 | A | | 10/1985 |
| WO | 9816712 | A1 | | 4/1998 |
| WO | 0111191 | A1 | | 2/2001 |
| WO | WO-2014186415 | A2 | * | 11/2014 ..... E21B 10/26 |
| WO | 2021112843 | A1 | | 6/2021 |

OTHER PUBLICATIONS

CN-102644458-B English Language Translation (Year: 2014).*

CN-109751043-A English Language Translation (Year: 1999).*

Gaddy, Dean E., "Rotary-steerable system drills 300,000 ft of hole", Oil & Gas Journal, 97, 20, May 17, 1999, p. 57.

Bonner et al., "Measurements at the Bit: A New Generation of MWD Tools", Oilfield Review, Apr./Jul. 1993, pp. 44-54.

Donati et al., "Innovative Rotary Closed Loop System—Engineering Concept Proven by Extensive Field Application in the Adriatic Sea", SPE-39328-MS presented at the IADC/SPE Drilling Conference, Dallas, Texas, Mar. 1998.

Garig et al., "Improving Drilling and Completion Performance in the Norwegian North Sea", SPE-79819-MS presented at the SPE/IADC Drilling Conference, Amsterdam, Netherlands, Feb. 2003.

(56) References Cited

OTHER PUBLICATIONS

Kinn et al., "Use of a Rotary Steerable Tool at the Valhall Field, Norway", SPE-59217-MS presented at the IADC/SPE Drilling Conference, New Orleans, Louisiana, Feb. 2000.
Poli et al., "Advanced Tools for Advanced Wells: Rotary Closed-Loop Drilling System-Results of Prototype Field Testing", SPE Drill & Compl 13 (02), SPE-36884-PA, Jun. 1, 1998, pp. 67-72.
International Search Report and Written Opinion, PCT/US2023/015516, Dec. 7, 2023, 9 pages.

* cited by examiner

WELLBORE DOWNLINK COMMUNICATION

TECHNICAL FIELD

The present disclosure relates generally to systems and methods for use in a well-drilling environment. More specifically, but not by way of limitation, this disclosure relates to techniques for communicating with downhole tools in the well-drilling environment.

BACKGROUND

As wellbores are drilled into a formation, a drilling trajectory may stray from a planned trajectory indicated in a well plan. A directional driller may correct for the stray (i.e., a wellbore trajectory error) by downlinking inclination and azimuth set-point changes or set points to a rotary steerable system that steers a drill bit. Inefficiencies and inaccuracies in downlink communication may interfere with the accuracy of the trajectory of the drilled wellbore. Further, many downlinking technologies rely on expensive equipment that is added to surface structures and bottom hole assemblies. Such equipment may, in some examples, interfere with drilling or other downhole operations.

DETAILED DESCRIPTION

Figure 1:
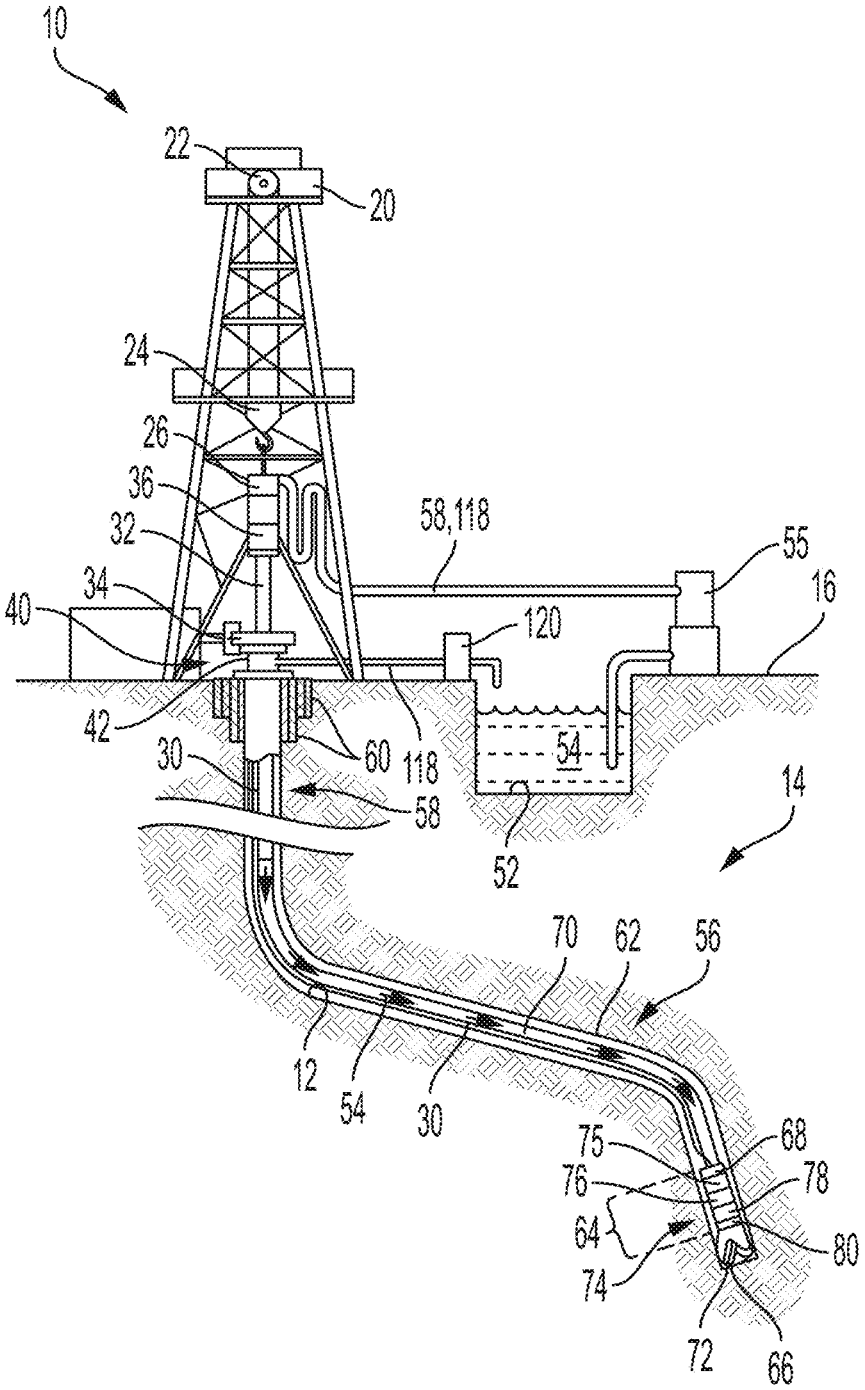
FIG. 1 is a cross-sectional view of an example of a well system incorporating a rotary steerable system according to one aspect of the present disclosure.

Certain aspects and features relate to techniques for communicating with downhole tools in the well-drilling environment. For example, a bottom hole assembly in a well-drilling environment can receive information from downhole sensors representing downlink signals originating from a surface of a wellbore. A bottom hole assembly can decode the signals and perform downhole operations based on the decoded signals. For example, the decoded signals may represent adjustment instructions for a drill bit used during a directional drilling operation. The adjustment instructions may provide instructions to a rotary steerable system, for example, to control a direction of the drill bit, such as an inclination, an azimuth, or both. Other downlink communications may also be transmitted from the surface of the wellbore for receipt by the bottom hole assembly.

Some examples include systems and methods usable to receive downlink communications during a drilling operation of a wellbore using components present on the bottom hole assembly. For example, a measurement-while-drilling (MWD) package may measure rotation of the bottom hole assembly downhole from a mud motor, and the rotation of the bottom hole assembly may represent data transmitted as a downlink signal. In some examples, the rotation of the bottom hole assembly downhole represents a flow rate of drilling fluid injected into the wellbore. Downlink signals may be encoded by changing the flow rate of the drilling fluid, and the changes in the rotation of the bottom hole assembly may be decoded at the bottom hole assembly to generate the downlink signal. In additional examples, the rotation of the bottom hole assembly may be recorded and decoded based on rotation of the drill string from the surface in addition to or in place of rotation generated by the flow of drilling fluid (e.g., from a mud motor at the bottom hole assembly). In still other examples, the downlink signal may be detected by a turbine in a generator that is located at the bottom hole assembly and activated by a flow of drilling fluid. The turbine in the generator may output an electrical signal, and the electrical signal may be used to determine a flow of drilling fluid at the bottom hole assembly. Any fluid flow detection, tool rotation detection, or combination thereof may be used to decode signals transmitted from the surface of the wellbore.

Enabling downlink communication using existing downhole components may enhance operability of downhole tools. For example, downlink communications using add-on components may be costly and lead to drilling inefficiencies. Further, the presently disclosed downlinking system may provide a backup system to other downlinking systems that rely on additional components that are not already present in the well if those additional components experience a malfunction.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 2:
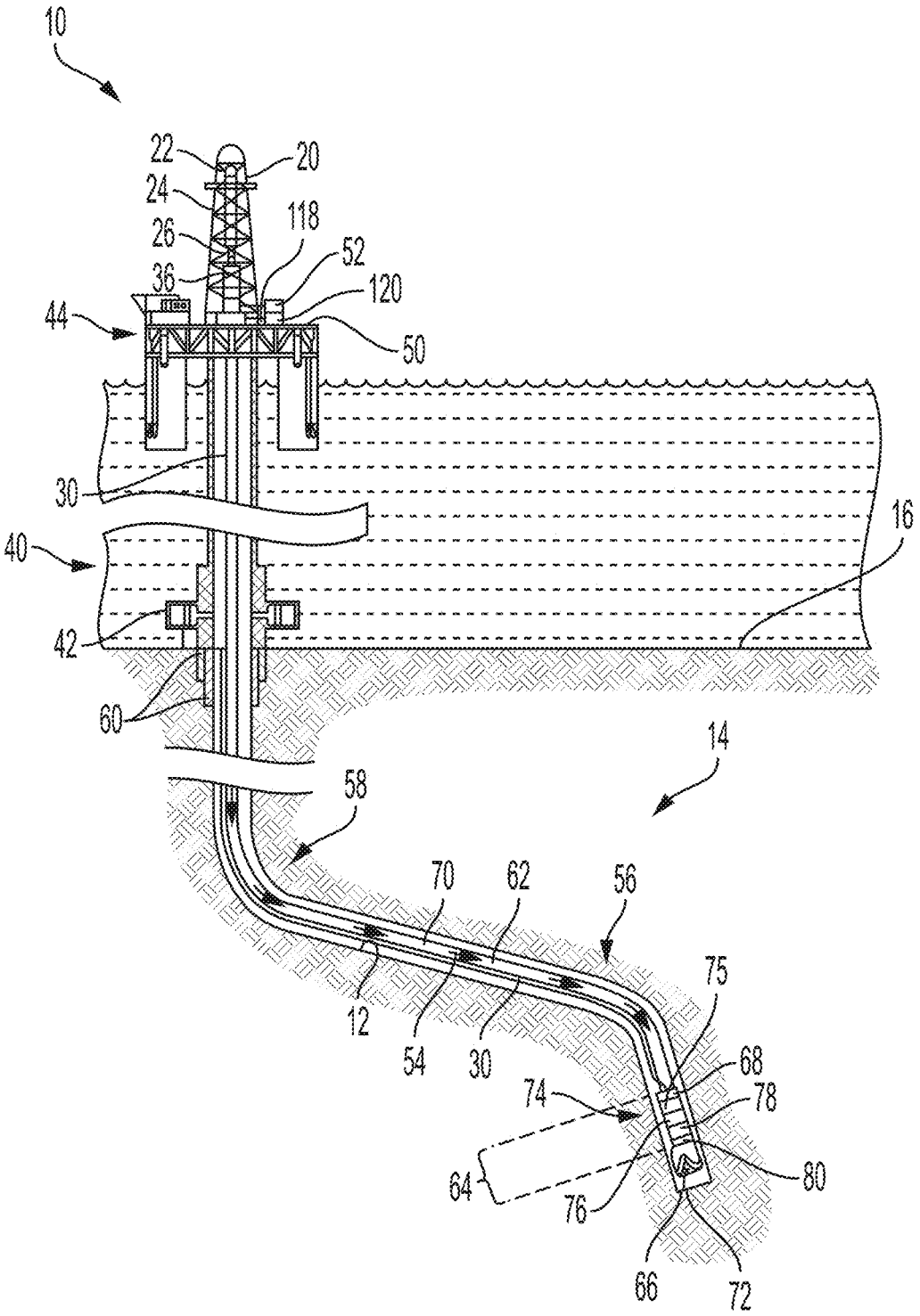
FIG. 2 is a cross-sectional view of an example of a marine-based well system incorporating a rotary steerable system according to one aspect of the present disclosure.

Turning to FIGS. 1 and 2, shown is a cross-sectional view of a well system 10 used to produce hydrocarbons from a wellbore 12 extending through various earth strata in an oil and gas formation 14 located below the earth's surface 16 according to one aspect of the present disclosure. The wellbore 12 may be formed of a single or multiple bores, extending into the formation 14, and disposed in any orientation. FIG. 1 depicts the system 10 in an on-shore environment and FIG. 2 depicts the system 10 in an off-shore environment.

Drilling and production system 10 includes a drilling rig or derrick 20. The drilling rig 20 may include a hoisting apparatus 22, a travel block 24, and a swivel 26 for raising and lowering casing, drill pipe, coiled tubing, production tubing, other types of pipe or tubing strings or other types of conveyance vehicles such as wireline, slickline, and the like 30. In FIG. 1, the conveyance vehicle 30 may be a substantially tubular, axially extending drill string formed of a plurality of drill pipe joints coupled together end-to-end. The drilling rig 20 may include a kelly 32, a rotary table 34, and other equipment associated with rotation and/or translation of the tubing string 30 within the wellbore 12. For some applications, the drilling rig 20 may also include a top drive unit 36.

The drilling rig 20 may be located proximate to a wellhead 40 as shown in FIG. 1, or spaced apart from the wellhead 40, such as in the case of an offshore arrangement as shown in FIG. 2. One or more pressure control devices 42, such as blowout preventers (BOPs) and other equipment associated with drilling or producing a wellbore may also be provided at the wellhead 40 or elsewhere in the system 10.

For offshore operations, such as illustrated specifically in FIG. 2, whether drilling or production, the drilling rig 20 may be mounted on an oil or gas platform 44, such as the offshore platform as illustrated, semi-submersibles, drill ships, and the like (not shown). Although the system 10 of FIG. 2 is illustrated as being a marine-based production system, the system 10 of FIG. 2 may be deployed on land. Likewise, although the system 10 of FIG. 1 is illustrated as being a land-based drilling system, the system 10 of FIG. 1 may be deployed offshore. In any event, for marine-based systems, one or more subsea conduits or risers 46 extend from a deck 50 of the platform 44 to the subsea wellhead 40. The tubing string 30 extends down from the drilling rig 20, through the subsea conduit 46 and the BOP 42 into the wellbore 12.

A working or service fluid source 52, such as a storage tank or vessel, may supply a working fluid 54 pumped by pump 55 to the upper end of the tubing string 30 and flow through the tubing string 30. The working fluid source 52 may supply any fluid utilized in wellbore operations, including without limitation, drilling fluid, cementious slurry, acidizing fluid, liquid water, steam or some other type of fluid.

The wellbore 12 may include subsurface equipment 56 disposed therein, such as, for example, a drill bit 66 and bottom hole assembly (BHA) 64, a completion assembly or some other type of wellbore tool.

The well system 10 may generally be characterized as having a pipe system 58. For purposes of this disclosure, the pipe system 58 may include casing, risers, tubing, drill strings, completion or production strings, subs, heads or any other pipes, tubes or equipment that couples or attaches to the foregoing, such as the string 30, the conduit 46, collars, and joints, as well as the wellbore and laterals in which the pipes, casing and strings may be deployed. In this regard, the pipe system 58 may include one or more casing strings 60 that may be cemented in the wellbore 12, such as the surface, intermediate, and production casings 60 shown in FIG. 1. An annulus 62 is formed between the walls of sets of adjacent tubular components, such as the concentric casing strings 60 or the exterior of the tubing string 30 and the inside wall of the wellbore 12 or the casing string 60, as the case may be.

Where the subsurface equipment 56 is used for the drilling and conveyance vehicle 30 as a drill string, the lower end of the drill string 30 may include the BHA 64, which may carry, at a distal end, the drill bit 66. During drilling operations, weight-on-bit (WOB) is applied as the drill bit 66 is rotated, thereby enabling the drill bit 66 to engage the formation 14 and drill the wellbore 12 along a predetermined path toward a target zone. In general, the drill bit 66 may be rotated with the drill string 30 from the rig 20 with the top drive 36 or the rotary table 34, with a downhole mud motor 68 within BHA 64, or using a combination thereof. The working fluid 54, which may also be referred to herein as drilling fluid or drilling mud, pumped to the upper end of the drill string 30 flows through the longitudinal interior 70 of the drill string 30, through the bottom hole assembly 64, and exits from nozzles formed in the drill bit 66. At downhole end 72 of the wellbore 12, the drilling fluid 54 may mix with formation cuttings, formation fluids, and other downhole fluids and debris. The drilling fluid mixture may then flow in an uphole direction through an annulus 62 to return formation cuttings and other downhole debris to the surface 16.

The bottom hole assembly 64, the drill string 30, or both may include various other tools 74, including a flow control device 75, a downhole generator 76, a rotary steerable system 78, and sampling and measurement equipment 80, such as formation testing and sampling tools, measurement while drilling (MWD) tools, logging while drilling (LWD) instruments, detectors, circuits, or other equipment to provide information about the wellbore 12 and the formation 14, such as samples or logging or measurement data from the wellbore 12. Measurement data and other information from the tools 74 may be communicated using electrical signals, acoustic signals, or other telemetry that can be converted to electrical signals at the rig 20 to, among other things, monitor the performance of the drilling string 30, the bottom hole assembly 64, and the associated drill bit 66, as well as monitor the conditions of the environment to which the bottom hole assembly 64 is subjected.

Fluids, cuttings, and other debris returning to surface 16 from the wellbore 12 are directed by a flow line 118 to storage tanks 52 or processing systems 120, such as shakers, centrifuges and the like.

The flow control device 75 controls the flow of working fluid to the BHA 64. Flow control device 75 may be disposed above the BHA 64 or be part of the BHA 64. The downhole generator 76 may be any power source standard in the art including, but not limited to, a power section having a stator and a rotor. In some examples, a battery may also be disposed in the BHA 64 to provide power when a flow of fluid is not able to generate power at the downhole generator 76.

Figure 3:
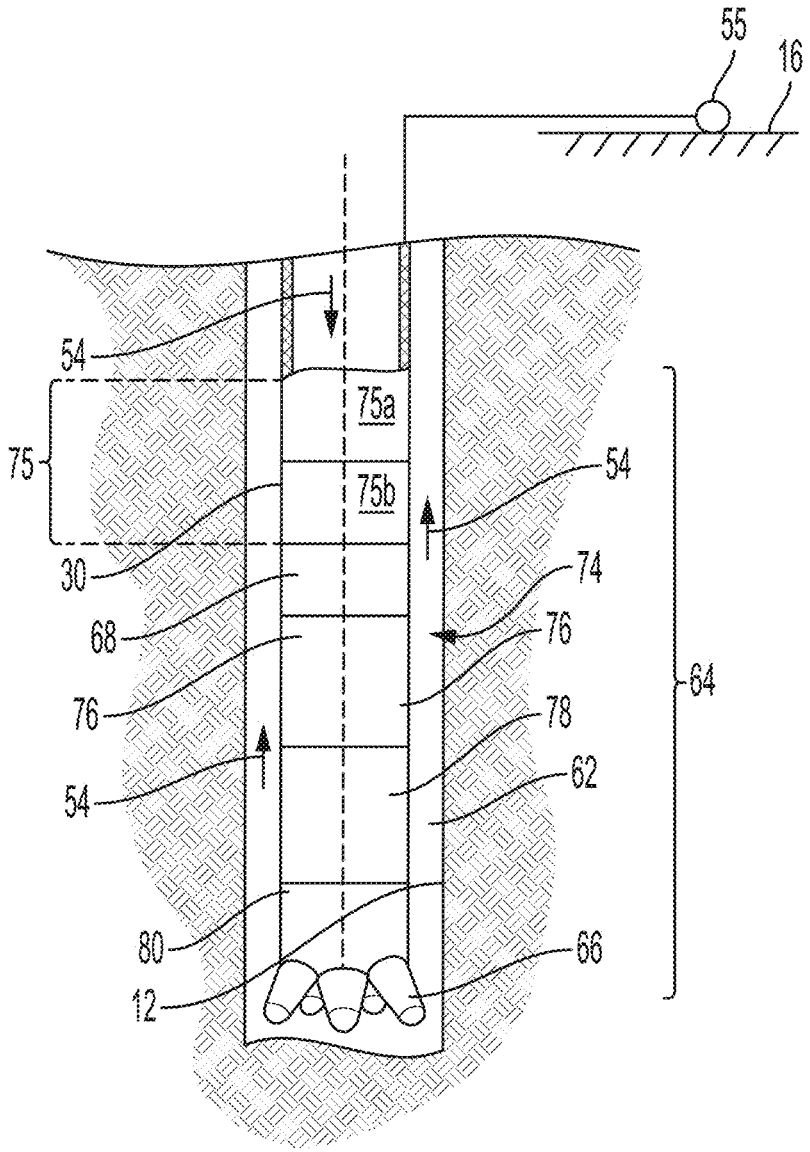
FIG. 3 is a sectional view of a portion of the well system of FIGS. 1 and 2 with a flow control device.

FIG. 3 depicts a sectional view of a portion of the well system 10 of FIGS. 1 and 2 with the flow control device 75 for controlling fluid flow to the downhole tools 74 and equipment according to one aspect of the present disclosure. More particularly, the flow control device 75 includes an actuator assembly 75*a* and a flow diverter assembly 75*b*.

The actuator assembly 75*a* may be used to drive the flow diverter assembly 75*b* between various configurations. A first configuration enables a first flow path and fluid communication through the interior of the BHA 64 to equipment 74, such as the downhole generator 76; a second configuration enables a second flow path and fluid communication through the central bore of the BHA 64 to the equipment 74, such as sampling equipment 80; and a third configuration enable a third flow path and fluid communication to annulus 62 and the exterior of the BHA 64.

The actuator assembly 75*a* may be mechanically actuated or electronically actuated. In a mechanically actuated embodiment, changes in pressure of the working fluid 54 pumped from the surface 16 may be used to control the actuator assembly 75*a*, which in turn drives the diverter assembly 75*b* to divert fluid flow from a central bore of the BHA 64 to the annulus 62, or to otherwise alter flow paths within the BHA 64. In some examples, the flow control device 75 may enable the use of the mud motor 68 and the sampling device 80 in the same BHA 64, for example by diverting some of the fluid flow to the sampling device 80 instead of the mud motor 68. In some examples, the downlink communication from the surface that is encoded by the flow of the working fluid 54 may take into account changes in the state of the flow control device 75. For example, the downlink communication may provide a signal to the BHA 64 indicating an upcoming change in the flow of the working fluid 54 that is received at the mud motor 68 due to a diversion by the flow control device 75. Based on this downlink signal, the BHA 64 may recognize that a particular observed change is not a triggering event for a downlink signal that should be decoded.

Figure 4:
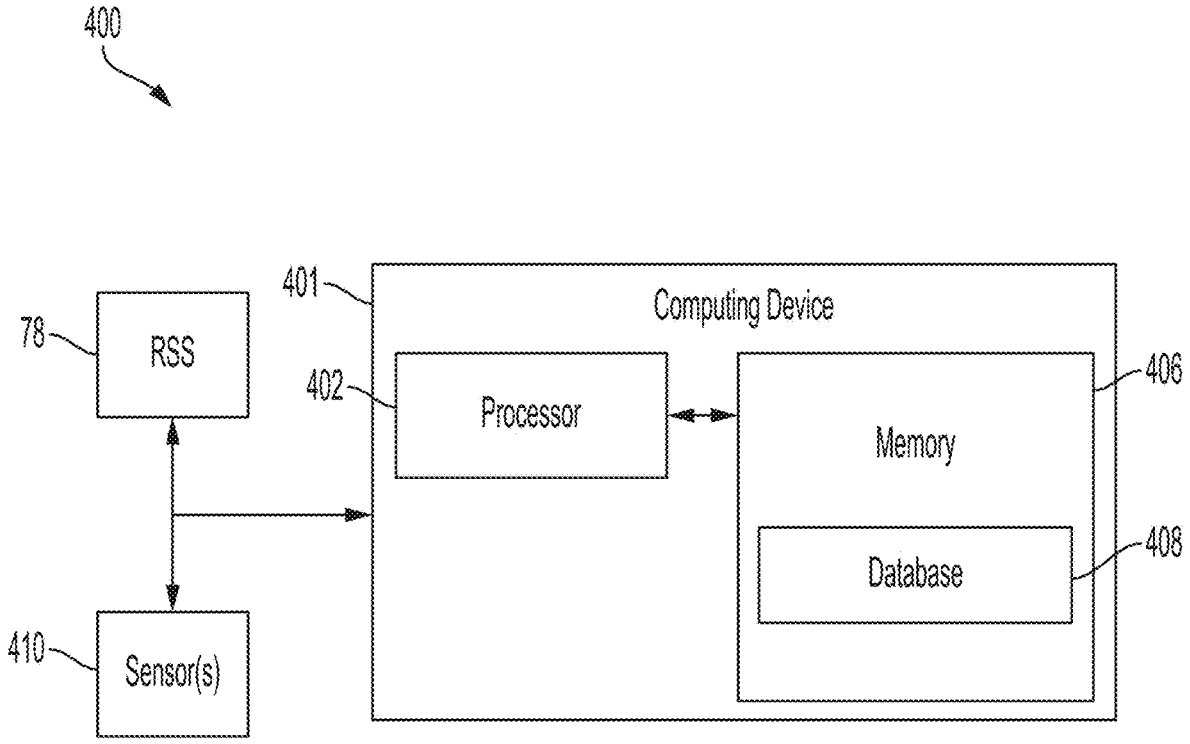
FIG. 4 is a block diagram of an example of a downlink communication system according to one aspect of the present disclosure.

FIG. 4 is a block diagram of a downlink communication system 400 that may be disposed in the BHA 64 according to some examples of the present disclosure. The downlink communication system 400 can include a computing device 401 having a processor 402 and a memory 406. In some examples, the components shown in FIG. 4 (e.g., the processor 402 and the memory 406) can be integrated into a single structure. For example, the components can be within a single housing at the BHA 64. In other examples, the components shown in FIG. 4 can be distributed (e.g., in separate housings) and in communication with each other.

Sensor(s) 410, which may form part of the sampling and measurement equipment 80 described above with respect to FIGS. 1 and 2, can be communicatively coupled to the computing device 401 to transmit information about the drill bit 66 within the wellbore 12. Examples of the sensors 410 can include measurement-while-drilling (MWD) sensors useable to measure rotation of the BHA 64 and position and attitude of the drill bit 66. In some examples, the sensors 410 can be integrated on the rotary steerable system (RSS) 78 (e.g., the sensors 410 are within the RSS 78). The sensors 410 can include gyroscopes, accelerometers, magnetometers, or any other sensors that are able to determine rotation of the BHA 64 and position and altitude of the drill bit 66. Additionally, the sensors can include an electrical sensor, such as a voltmeter, capable of reading an output signal of the downhole generator 76, which may represent a flow rate of the working fluid 54 flowing through the downhole generator 76.

The processor 402 can execute one or more operations for implementing some examples. The processor 402 can execute instructions stored in the memory 406 to perform the operations. The processor 402 can include one processing device or multiple processing devices. Non-limiting examples of the processor 402 include a Field-Programmable Gate Array ("FPGA"), an application-specific integrated circuit ("ASIC"), a microprocessor, etc.

The processor 402 can be communicatively coupled to the memory 406 via a bus. The non-volatile memory 406 may include any type of memory device that retains stored information when powered off. Non-limiting examples of the memory 406 include electrically erasable and programmable read-only memory ("EEPROM"), flash memory, or any other type of non-volatile memory. In some examples, at least some of the memory 406 can include a medium from which the processor 402 can read instructions. A computer-readable medium can include electronic, optical, magnetic, or other storage devices capable of providing the processor 402 with computer-readable instructions or other program code. Non-limiting examples of a computer-readable medium include (but are not limited to) magnetic disk(s), memory chip(s), ROM, RAM, an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

The memory 406 can include a database 408, which can include any amount and combination of the content described in previous examples. The database 408 can store instructions for decoding downlink signals and implementing the decoded downlink signals at the downhole tools, among other things.

Figure 5:
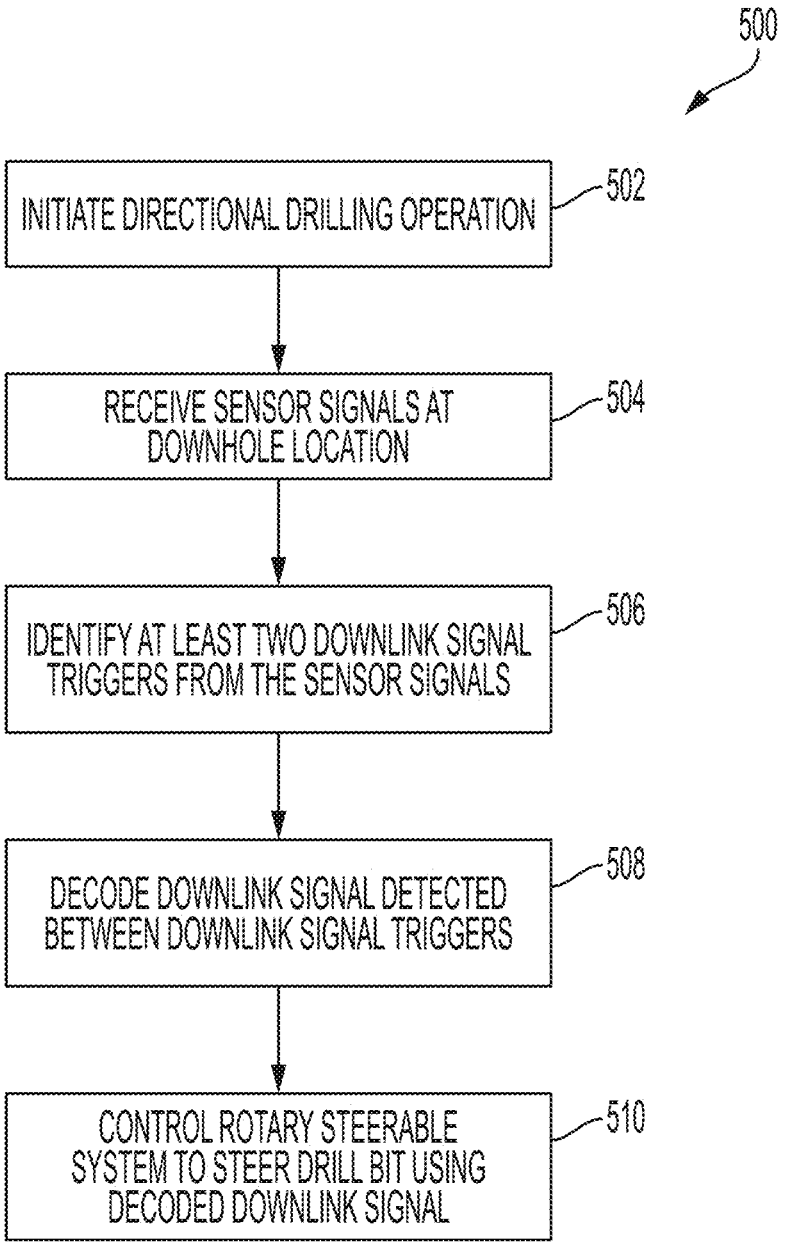
FIG. 5 is a flowchart describing a process for decoding downlink communication signals according to one aspect of the present disclosure.

FIG. 5 is a flowchart describing a process 500 for decoding downlink communication signals according to one example of the present disclosure. For illustrative purposes, the process 500 is described with reference to certain examples depicted in the figures. For example, the process 500 may be performed by the processor 402 of the computing device 401 by implementing instructions stored on the memory 406. Other implementations, however, are possible.

At block 502, the processor 402 may initiate a directional drilling operation. In some examples the rotary steerable system 78 may enable drilling of a wellbore in a direction designated by the rotary steerable system 78 and often in accordance with a pre-determined well plan. While the process 500 is described with reference to a directional drilling operation, the process 500 may be used for any implementation where downlink communication may be beneficial.

At block 504, the processor 402 may receive sensor signals at a downhole location from the sensors 410. The sensor signals may include an indication of rotation of the BHA 64 or an indication of an output of the downhole generator 76. In an example, the rotation of the BHA 64 may occur based on rotation of the entire drill string 30, such as by the kelly 32 or the rotary table 34, based on the flow of the working fluid 54 through the mud motor 68 resulting in the rotation of the BHA 64, or a combination thereof. The sensor signals received by the processor 402 from the sensors 410 may represent downlink communication signals generated at the surface and encoded at the surface in the working fluid 54, the rotation of the drill string 30, or both.

At block 506, the processor 402 may identify at least two downlink signal triggers from the sensor signals. In an example, the database 408 of the memory 406 may define events that indicate an initiation and a conclusion of a downlink communication. For example, the processor 402 may define the downlink signals as being information encoded between the at least two downlink signal triggers. Examples of triggering events may be edge detections, pump flow rate thresholds, downhole tool rotation rate thresholds, pump flow rate of change thresholds, downhole tool rotation rate of change thresholds, timing thresholds (e.g., a signal length), or any other triggering events that may be identified based on the pump flow rate of the working fluid 54, rotation of the drill string 30, or a combination thereof.

At block 508, the processor 402 may decode a downlink signal detected between the downlink signal triggers. The downlink signal may be encoded at the surface in a number of ways to transmit signals to the BHA 64. In some examples, the encoding is timing based. For example, the BHA 64 may decode the downlink signal based on a measured amount of time between a first downlink signal trigger and a second downlink signal trigger. In other examples, the BHA 64 may decode the downlink signal based on pulse position modulation (PPM) encoding of the downlink signal through varying the flow rate, rotary speed, or both using surface equipment. In an example, the PPM encoding may enable more efficient transmission of information with fewer transitions than other techniques. Accordingly, the PPM encoding may enable transmission of complex commands in the downlink signal in an efficient manner.

At block 510, the processor 402 may control the rotary steerable system 78 to steer the drill bit 66 using the decoded downlink signal. For example, the downlink signal may control inclination and azimuth set-point changes of the rotary steerable system 78. Other types of downlink communications can also be decoded using the techniques described in the process 500. For example, the downlink signal may also be used to control various other downhole tools located at the BHA 64. In such an example, the downlink signal may be a signal to "reset all electronics," to "switch BHA surveying mode," or any other instructions usable to control operation of a downhole tool.

FIGS. 6-14 are depicted to help illustrate the encoded downlink signals received by the sensors 410 at the BHA 64. In some examples, three modes may be used to control the downhole tools at the BHA 64. A first mode may be referred to as a simplified mode, where simplified downlinks define a timing interval between two triggering events, such as a pump flow turn-on threshold and a rotary turn-on threshold. Detection of the rotary turn-on threshold may be performed using the rotary steerable system 78, such as a mud-motor assisted rotary steerable system (MARSS). The detection of the rotary turn-on event may be delayed by adjusting the flow rate of the working fluid 54 to below the rotary turn-on threshold. In an example, the pump flow turn-on threshold may be detected by detecting a turbine RPM of the downhole generator 76.

A second mode may be referred to as a flow/rotary downlink mode. The flow/rotary downlink mode may include downlinks encoded using pulse position modulation and edge encoding. The pulse position modulation may enable encoding of more complex signals, and the edge encoding may enable added flexibility in magnitudes of transitions generating the signals and may also enable the baseline to change without affecting or restricting the transmission. In other words, a specific magnitude of flow or rotation does not need to be reached to send a downlink communication signal.

A third mode may be referred to as a flow rate change mode. The flow rate change mode may use turbine RPM of the downhole generator 76 to decode the downlink signals. The flow rate change mode may rely on a table of transmission parameters defining various commands according to detected flow rate changes.

Figure 6:
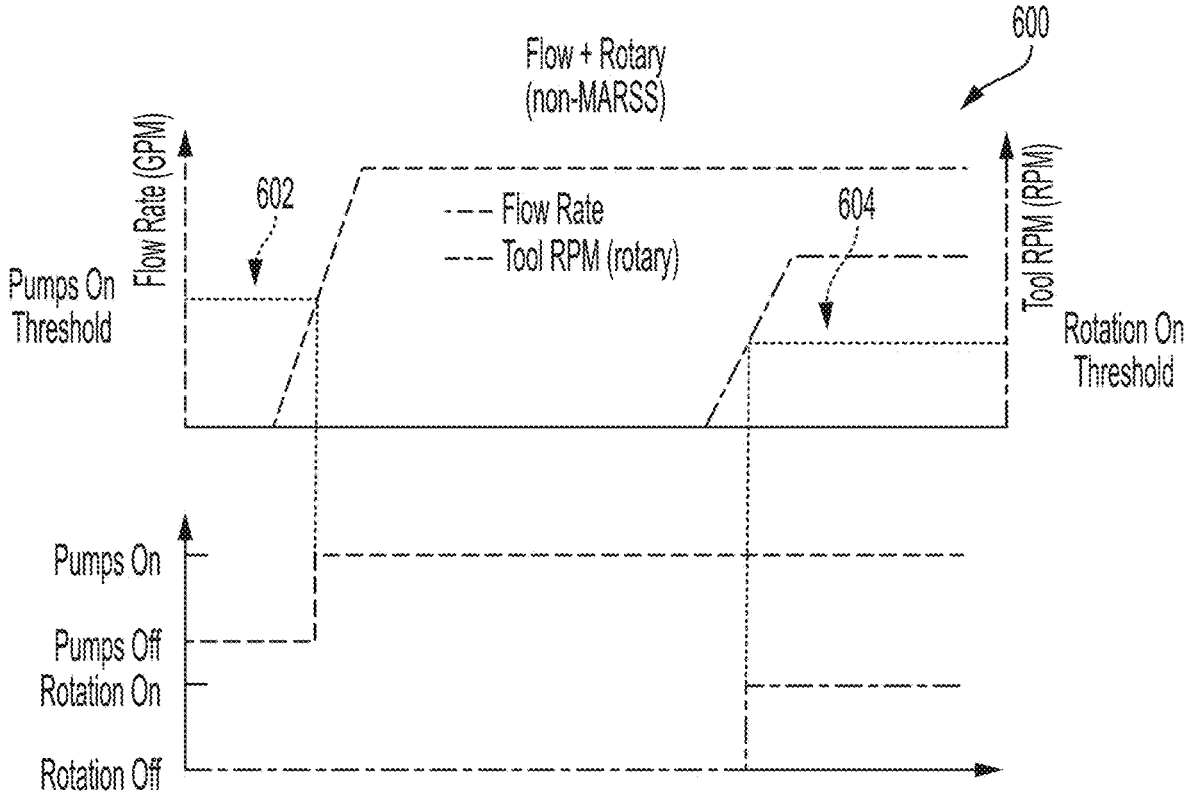
FIG. 6 depicts a graph depicting a downlink signal encoded using the simplified mode according to one aspect of the present disclosure.

FIG. 6 depicts a graph 600 depicting a downlink signal encoded using the simplified mode according to one aspect of the present disclosure. The graph 600 depicts encoding using a pumps-on threshold 602 and a rotation-on threshold 604 in a non-MARSS implementation. When flow of the working fluid 54 and rotation of the BHA 64 are independent, then a message may be defined by a time between the turn on of each of the controlled parameters, such as pump flow rate and tool RPM. This instance may occur when the tool RPM reaches the rotation-on threshold from rotation of the drill string 30 without rotation also provided by the downhole mud motor 68.

In this example, the first triggering event beginning the downlink signal is the crossing of the pumps-on threshold 602, as measured by the flow rate of the working fluid 54 in gallons per minute (GPM). The second triggering event, which ends the downlink signal, is the crossing of the rotation-on threshold 604, as measured by tool rotations per minute (RPM). In some examples, the threshold triggering events may be a rate of change of the flow rate of the working fluid 54 and a rate of change of the rotation of the BHA 64.

Figure 7:
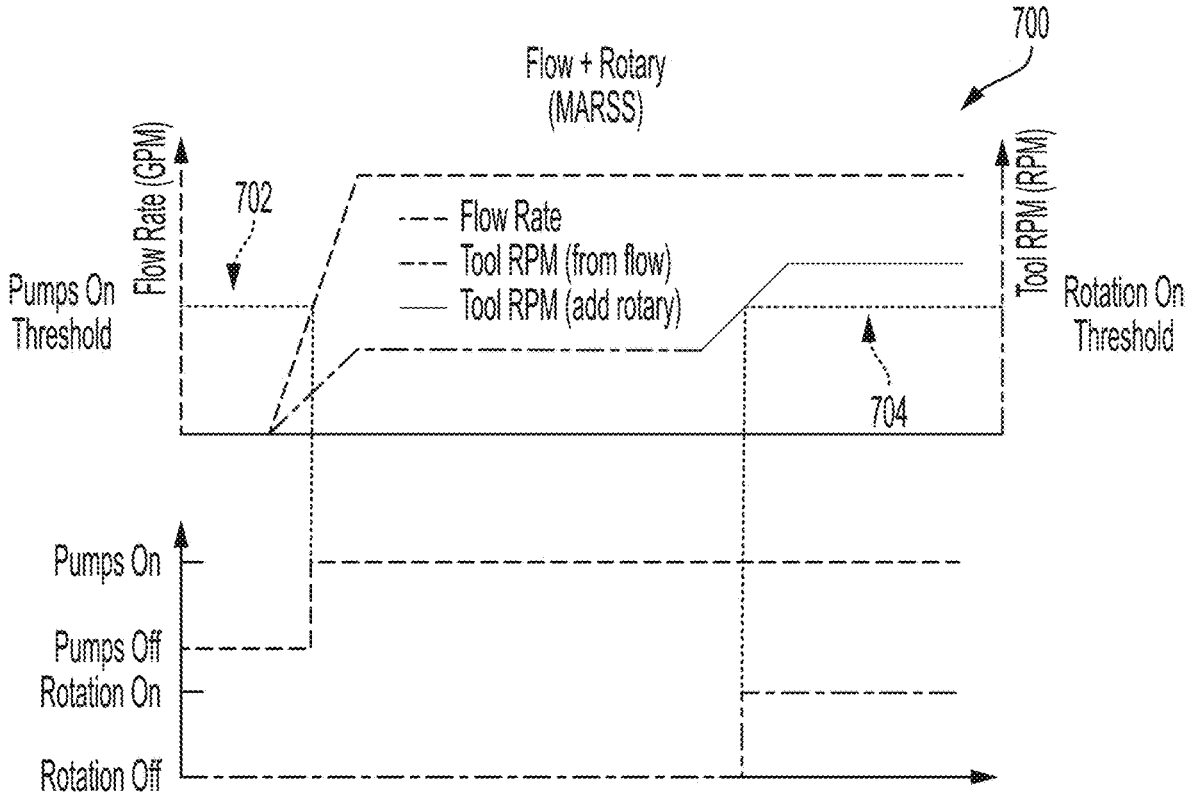
FIG. 7 depicts a graph depicting an additional downlink signal encoded using the simplified mode according to one aspect of the present disclosure.

FIG. 7 depicts a graph 700 depicting an additional downlink signal encoded using the simplified mode according to one aspect of the present disclosure. The graph 700 depicts encoding of the downlink signal using a pumps-on threshold 702 and a rotation-on threshold 704 in a MARSS implementation. When flow of the working fluid 54 and rotation of the BHA 64 are not independent, such as in the MARSS implementation, then the flow rate may be turned on to a point that reaches the pumps-on threshold but does not cause the mud motor 68 to rotate the BHA 64 at above the rotation-on threshold. To define the end of the transmission, the drill string 30 may be rotated at a sufficient rate for the BHA 64 to exceed the rotation-on threshold 704. As with the graph 600, the message may be defined by a time between the turn on of each of the controlled parameters, such as pump flow rate and tool RPM, where the tool RPM is established by combining the rotation provided by the mud motor 68 and the rotation provided by the drill string 30.

In this example, the first triggering event beginning the downlink signal is the crossing of the pumps-on threshold 702. The second triggering event, which ends the downlink signal, is the crossing of the rotation-on threshold 604, as established by the combination of the rotation from the mud motor 68 and the drill string 30. In some examples, the threshold triggering events may be a rate of change of the flow rate of the working fluid 54 and a rate of change of the rotation of the BHA 64.

Figure 8:
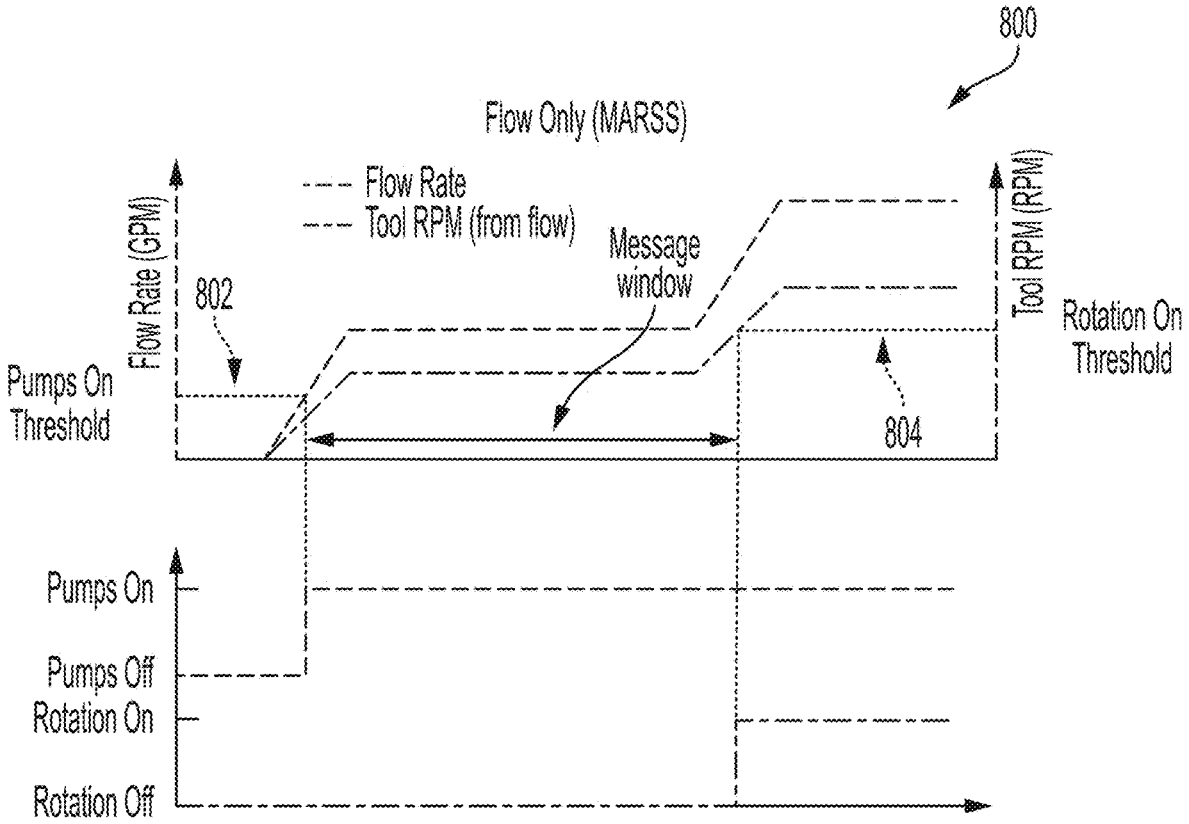
FIG. 8 depicts a graph depicting an additional downlink signal encoded using the simplified mode according to one aspect of the present disclosure.

FIG. 8 depicts a graph 800 depicting an additional downlink signal encoded using the simplified mode according to one aspect of the present disclosure. The graph 800 depicts encoding of the downlink signal using a pumps-on threshold 802 and a rotation-on threshold 804 in a MARSS implementation using only the flow of working fluid 54 to generate rotation of the BHA 64. When flow of the working fluid 54 and rotation of the BHA 64 are not independent, such as in the MARSS implementation, then the flow rate may be turned on to a point that reaches the pumps-on threshold but does not cause the mud motor 68 to rotate the BHA 64 at above the rotation-on threshold 804. To define the end of the transmission, the flow of the working fluid 54 may be increased to a sufficient rate for the BHA 64 to exceed the rotation-on threshold 804. As with the graph 600, the message may be defined by a time between the turn on of each of the controlled parameters, such as pump flow rate and tool RPM, where the tool RPM is established solely by the rotation provided by the mud motor 68. In other words, the transmission may occur while the drill string 30 is not rotated from the surface.

In this example, the first triggering event beginning the downlink signal is the crossing of the pumps-on threshold 802. The second triggering event, which ends the downlink signal, is the crossing of the rotation-on threshold 804, as established by the rotation from the mud motor 68. In some examples, the threshold triggering events may be a rate of change of the flow rate of the working fluid 54 and a rate of change of the rotation of the BHA 64.

The specific command of the graph 800 may represent setting a duty cycle of the rotary steerable system 78 to 0%. To encode this signal, a period of 60 seconds may be provided where the pumps-on threshold and the rotation-on threshold are not yet reached. Subsequently, the flow rate of the working fluid 54 may be increased to a level that exceeds the pumps-on threshold but does not exceed the rotation-on threshold. A waiting period of 20 seconds is initiated until the rotation-on threshold is reached either by rotating the drill string 30 sufficiently or by increasing the flow rate of the working fluid 54. The rotation-on threshold may be reached after 20 seconds but prior to reaching an established minimum toolface delay to establish the duty cycle setting of 0%. Such an encoding relies on an amount of time that passes between achieving the pumps-on threshold and achieving the rotation-on threshold.

While the graph 800 may show an example of how one instruction is encoded, other instructions may be encoded using different timing delays. For example, if the rotation-on threshold is exceeded prior to expiration of the 20 second delay after reaching the flow on threshold, then the instruction may be for the rotary steerable system 78 to be set to the most recent toolface setting and duty cycle setting.

Figure 9:
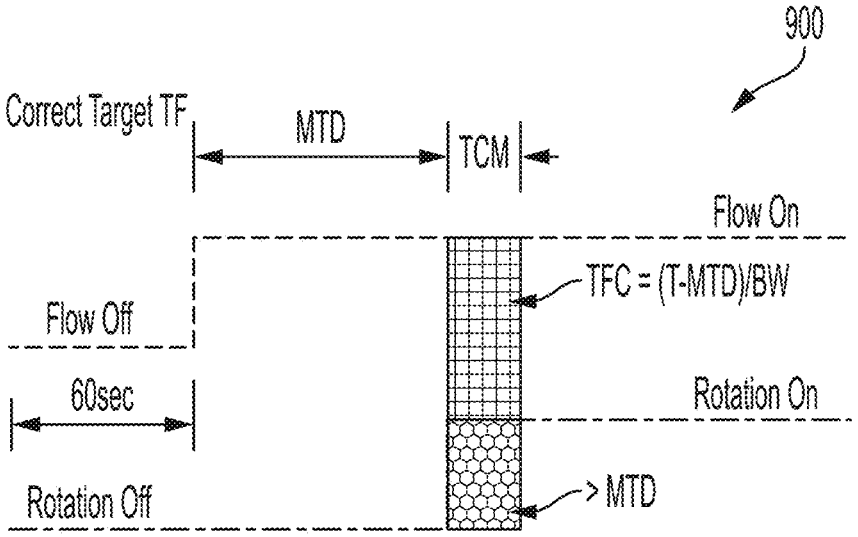
FIG. 9 depicts a graph depicting an example of a specific command of a downlink signal encoded using the simplified mode according to one aspect of the present disclosure.

To help illustrate, FIG. 9 depicts a graph 900 depicting an example of a specific command of a downlink signal encoded using the simplified mode according to one aspect of the present disclosure. The specific command of the graph 900 may represent correcting a toolface of the rotary steerable system 78. To encode this signal, a period of 60 seconds is provided where the pumps-on threshold and the rotation-on threshold are not yet reached. Subsequently, the flow rate of the working fluid 54 is increased to a level that exceeds the pumps-on threshold but does not exceed the rotation-on threshold. A waiting period of greater than the minimum toolface delay (MTD), which may be 40 seconds, is initiated until the rotation-on threshold is reached either by rotating the drill string 30 sufficiently or by increasing the flow rate of the working fluid 54. Each toolface correction may be encoded as a time delay with the following Equation 1:

$$T = MTD + BW * TFC \quad \text{(Equation 1)}$$

where T is the time delay, MTD is the minimum toolface delay, BW is a bit width, and TFC is the toolface correction. Through Equation 1, the toolface correction value can be calculated as the following Equation 2:

$$TFC = (T - MTD)/BW \quad \text{(Equation 2)}$$

In other words, Equation 1 is used to encode a downlinked signal indicating the toolface correction, and Equation 2 is used at the BHA 64 to decode the toolface correction from the downlinked signal. In some examples, a maximum time for a toolface correction message (TCM) is the bit width multiplied by a number of encoded values available for the toolface correction.

Figure 10:
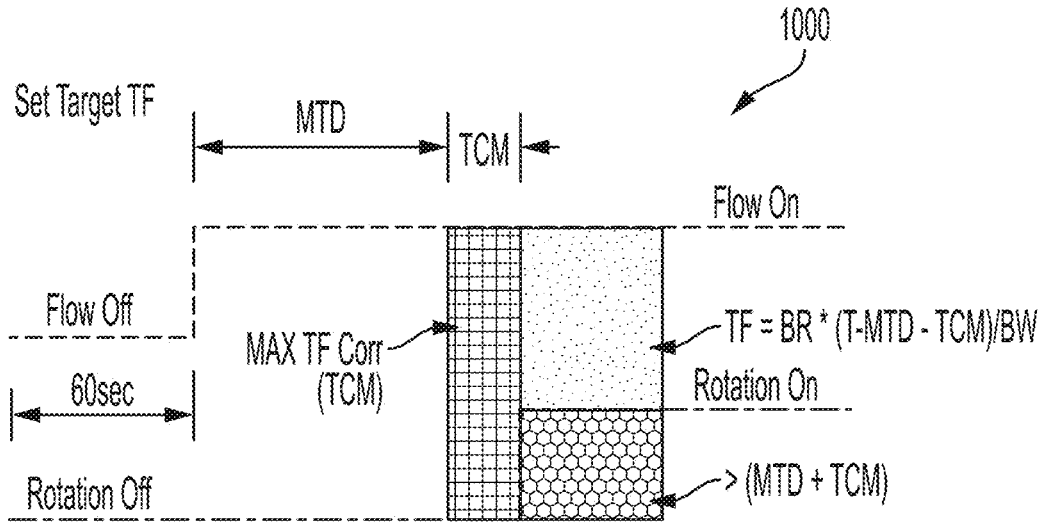
FIG. 10 depicts a graph depicting an example of a specific command of a downlink signal encoded using the simplified mode according to one aspect of the present disclosure.

FIG. 10 depicts a graph 1000 depicting an example of a specific command of a downlink signal encoded using the simplified mode according to one aspect of the present disclosure. The specific command of the graph 1000 may represent setting a value for a toolface of the rotary steerable system 78, as opposed to correcting the toolface in FIG. 9. To encode this signal, a period of 60 seconds is provided where the pumps-on threshold and the rotation-on threshold are not yet reached. Subsequently, the flow rate of the working fluid 54 is increased to a level that exceeds the pumps-on threshold but does not exceed the rotation-on threshold. A waiting period of greater than the minimum toolface delay (MTD) plus the maximum time for a TCM is initiated. After ending the waiting period, the rotation-on threshold is reached either by rotating the drill string 30 sufficiently or by increasing the flow rate of the working fluid 54 using the following Equation 3:

$$T = MTD + TCM + BWxTF/BR \quad \text{(Equation 3)}$$

where T is the time delay between reaching the pumps-on threshold and the rotation-on threshold, MTD is the minimum toolface delay, TCM is the maximum time for a toolface correction message, BW is a bit width, and TF is the toolface setting, and BR is the bit resolution. Through Equation 3, the toolface setting value can be calculated as the following Equation 4:

$$TF = BR * (T - MTD - TCM)/BW \quad \text{(Equation 4)}$$

In other words, Equation 3 is used to encode a downlinked signal indicating the toolface setting, and Equation 4 is used at the BHA 64 to decode the toolface setting from the downlinked signal.

Figure 11:
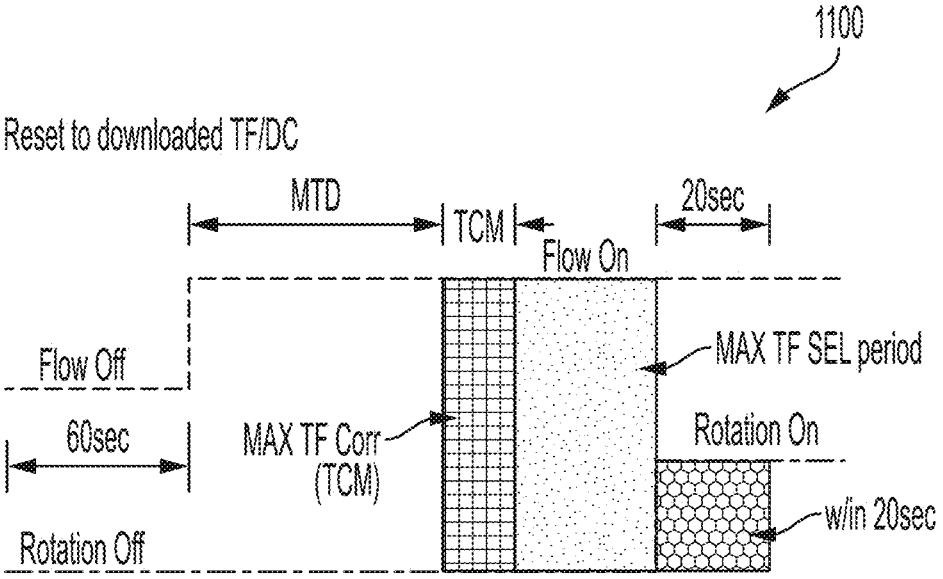
FIG. 11 depicts a graph depicting an additional example of a specific command of a downlink signal encoded using the simplified mode according to one aspect of the present disclosure.

FIG. 11 depicts a graph 1100 depicting an additional example of a specific command of a downlink signal encoded using the simplified mode according to one aspect of the present disclosure. The specific command of the graph 1100 may represent resetting the toolface and the duty cycle of the rotary steerable system 78. To encode this signal, a period of 60 seconds is provided where the pumps-on threshold and the rotation-on threshold are not yet reached. Subsequently, the flow rate of the working fluid 54 is increased to a level that exceeds the pumps-on threshold but does not exceed the rotation-on threshold. A waiting period of greater than the maximum time for the toolface setting is initiated. After ending the waiting period, which occurs after the maximum time for the toolface setting but prior to a maximum command time, the rotation-on threshold is reached either by rotating the drill string 30 sufficiently or by increasing the flow rate of the working fluid 54. The resulting encoded signal instructs the rotary steerable system 78 to reset the toolface and duty cycle. In an example, if the maximum command time is exceeded before achieving the rotation-on threshold, then no command is processed and the 60 second initial waiting period below the pumps-on threshold and the rotation-on threshold is reestablished prior to attempting another command.

Figure 12:
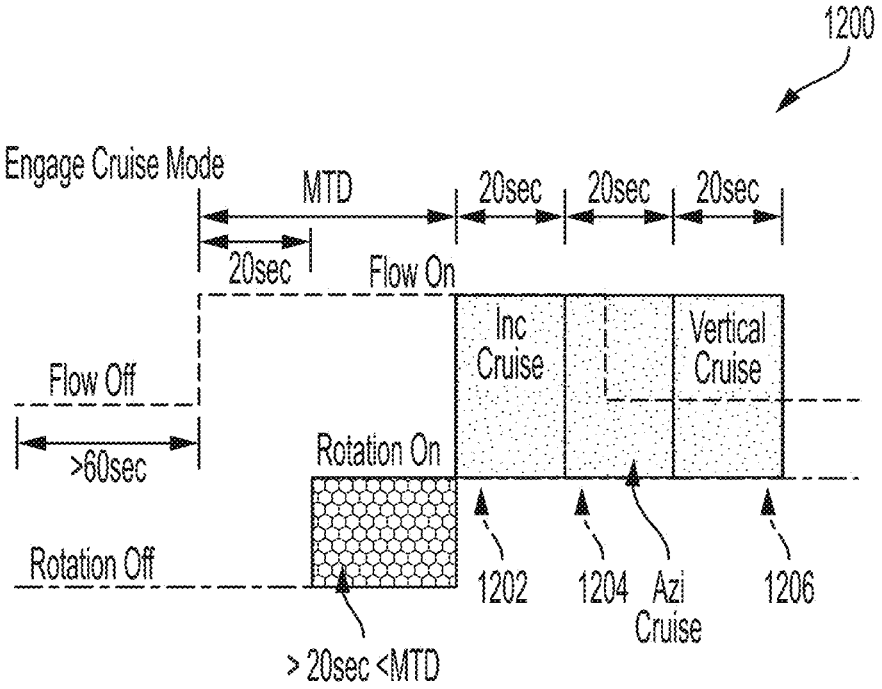
FIG. 12 depicts a graph depicting an additional example of a specific command of a downlink signal encoded using the simplified mode according to one aspect of the present disclosure.

FIG. 12 depicts a graph 1200 depicting an additional example of a specific command of a downlink signal encoded using the simplified mode according to one aspect of the present disclosure. The specific command of the graph 1200 may represent engaging cruise control of the rotary steerable system 78. To encode this signal, a period of 60 seconds is provided where the pumps-on threshold and the rotation-on threshold are not yet reached. Subsequently, the flow rate of the working fluid 54 is increased to a level that exceeds the pumps-on threshold but does not exceed the rotation-on threshold. A waiting period of greater than a minimum delay time (e.g., 20 seconds) is initiated. After ending the waiting period, the rotation-on threshold is reached either by rotating the drill string 30 sufficiently or by increasing the flow rate of the working fluid 54. The rotation-on threshold may be reached after the minimum delay time but prior to the minimum toolface delay. After the rotation-on threshold is reached, the flow of the working fluid 54 may be reduced below the pumps-on threshold when the desired cruise control window is reached (e.g., inclination cruise 1202, azimuth cruise 1204, or vertical cruise 1206). The selected cruise mode may engage immediately or on a subsequent pumping cycle.

While FIGS. 9-12 describe various techniques for encoding and decoding various downlink signals for use with the rotary steerable system 78 in the simplified mode, other encoding and decoding techniques may also be used to decode other downlink signals for the rotary steerable system 78 and other tools located at the BHA 64 using the simplified encoding mode described herein. For example, in some instances, the triggering events may include rate of change thresholds of the flow rate and the rotation rather than magnitude thresholds as described above. Further, other timing arrangements of the encoded signals may represent various additional commands that are decoded at the BHA 64.

Figure 13:
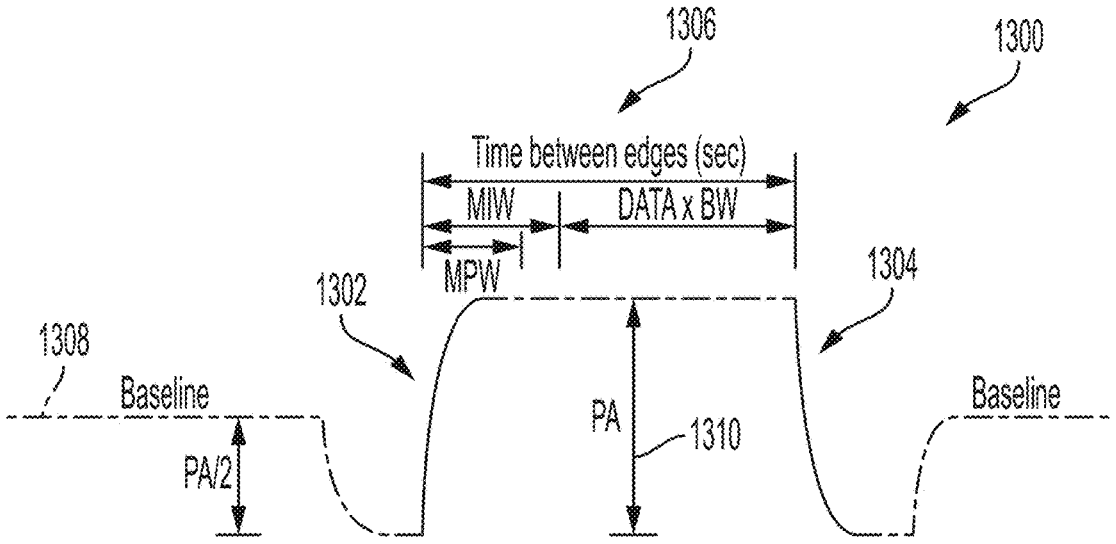
FIG. 13 depicts a graph depicting an example of a downlink signal encoded using the flow/rotary downlink mode according to one aspect of the present disclosure.

FIG. 13 depicts a graph 1300 depicting an example of a downlink signal encoded using the flow/rotary downlink mode according to one aspect of the present disclosure. The flow/rotary downlink mode may include downlinks encoded using pulse position modulation and edge encoding. The pulse position modulation may enable encoding of more complex signals, and the edge encoding may enable added flexibility in magnitudes of transitions generating the signals and may also enable the baseline to change without affecting or restricting the transmission. In other words, a specific magnitude of flow or rotation does not need to be reached to send a downlink communication signal.

In an example, the flow/rotary downlink mode may define pulse and data encoding using a set of parameters. For example, a minimum pulse width (MPW) (e.g., in seconds) may be established to defines a minimum hold time to allow a settling time of the drilling parameter (e.g., working fluid flow or tool rotation) used for transmission. A pulse amplitude (PA) may be a magnitude of the drilling parameter used for transmission as a percent from a baseline or drilling setting. A minimum interval width (MIW) may be a minimum length of time allowed for each interval transmitted. An encoding of actual values may begin after the MIW has elapsed, and the MIW may always be longer than MPW. A bit width (BW) is a fixed length of time window of any one value index to be transmitted. A minimum baseline delay is the total amount of quiet time (i.e., time without any transmission activity) used to detect the end of transmission and the potential start of a new transmission. When the baseline is selected to be a different value than the high or low of the pulse, a return to the baseline value may also be used as an early indication of the end of transmission without waiting for the full MPW delay to expire. In addition, not returning to the baseline at the end of a downlink may indicate a continuation of a subsequent downlink command allowing for concatenation of various back-to-back commands without incurring further delays.

The graph 1300 depicts an edge encoding scheme of the flow/rotary downlink mode. An edge 1302, 1304 is defined as the transition from one magnitude to another. The position in time of the edges 1302 and 1304 can be detected by various methods to extract a time between edges 1306 for the encoding the downlink message. Using the edge instead of measuring magnitudes enables more flexible encoding in the actual magnitude of the transitions and enables a baseline 1308 to change without affecting or restricting the transmission. The pulse amplitude (PA) 1310 may be a minimum amount that the underlying variable (e.g., flow or rotation) would need to change to properly define an edge with a given height and slope.

After an initial delay of the minimum baseline delay between transmissions at the current setting, the downlink may be initiated by an initial decrease from the baseline 1308 of the controller variable (e.g., flow in GPM or rotation in RPM) of at least half the pulse amplitude (PA) 1310 to generate the first edge 1302. After a wait of MPW, the next edge uses the full pulse amplitude 1310 and starts a first interval transmission. After a minimum interval width delay, data is encoded according to the bit width, and a subsequent transition is executed in the opposite direction to generate the edge 1304 and the end of the interval. The data is encoded between each edge transition. The transmission ends with the return to the baseline 1308.

In an example, the timing of the edges may encode signals in a manner similar to the pumps-on and rotation-on threshold timings described above with respect to the simplified mode. In other words, the first triggering event may be the first edge 1302, and the second triggering event may be the second edge 1304. The time between the first edge 1302 and the second edge 1304 may establish the encoded instructions that are downlinked to the BHA 64.

Figure 14:
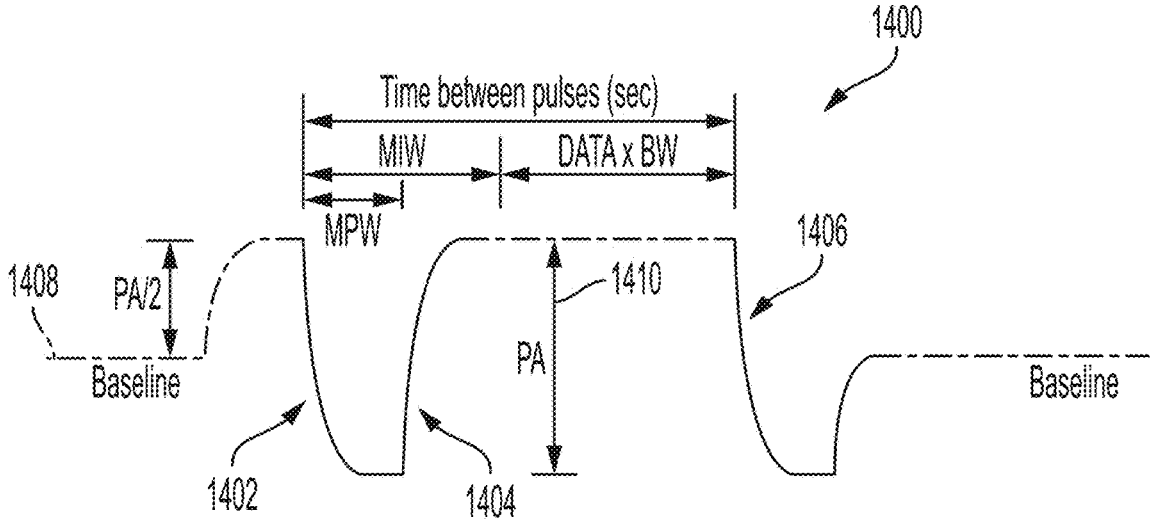
FIG. 14 depicts a graph depicting an additional example of a downlink signal encoded using the flow/rotary downlink mode.

FIG. 14 depicts a graph 1400 depicting an additional example of a downlink signal encoded using the flow/rotary downlink mode. The graph 1400 may represent pulse encoding of the flow/rotary downlink mode according to one aspect of the present disclosure. A pulse can be defined by two opposite edges 1402 and 1404 detected consecutively. The pulse encoding may use a difference in time between the start of every negative pulse (e.g., edges 1402 and 1406) detected to encode the downlink message.

As shown in the graph 1400 after an initial minimum baseline delay (MBD), the downlink may be initiated by an initial increase from a baseline 1408 of the controlled variable (e.g., flow in GPM or rotation in RPM) of at least half the pulse amplitude (PA) 1410. A pulse is then defined by a decrease of the full PA 1410 followed by an increase of the full PA 1410 after a minimum pulse width (MPW) delay. After the initial minimum interval width (MIW) delay, data is then encoded, and the time difference between each start of the downward pulse may define the transmission interval. The transmission ends with a return to the original baseline from the last downward edge 1406.

As used below, any reference to a series of examples is to be understood as a reference to each of those examples disjunctively (e.g., "Examples 1-4" is to be understood as "Examples 1, 2, 3, or 4").

Example 1 is a system comprising: at least one sensor positionable at a bottom hole assembly within a wellbore to detect flow of drilling fluid, a rotation of the bottom hole assembly, or a combination thereof; a rotary steerable system positionable within the wellbore to steer a drill bit; a processing device positionable to communicatively couple to the at least one sensor and the rotary steerable system; and a memory device comprising instructions that are executable by the processing device for causing the processing device to: receive sensor signals from the at least one sensor at the bottom hole assembly within the wellbore; identify at least two downlink signal triggers from the sensor signals; decode a downlink signal detected between each of the at least two downlink signal triggers; and control the rotary steerable system to steer the drill bit using the decoded downlink signal.

Example 2 is the system of example 1, wherein at least one of the at least two downlink signal triggers comprises a rate of change to the flow of drilling fluid, a rate of change the rotation of the bottom hole assembly, or a combination thereof.

Example 3 is the system of examples 1-2, wherein at least one of the at least two downlink signal triggers comprises an edge detection of a change in a magnitude of the flow of drilling fluid, the rotation of the bottom hole assembly, or a combination thereof.

Example 4 is the system of examples 1-3, wherein a first trigger of the at least two downlink signal triggers comprises a flow rate of the drilling fluid exceeding a pumps-on threshold.

Example 5 is the system of example 4, wherein a second trigger of the at least two downlink signal triggers comprises a rotation rate of the bottom hole assembly exceeding a rotation-on threshold.

Example 6 is the system of example 5, wherein the rotation-on threshold is achieved using a combination of a first rotation generated from rotating a drill string at a surface of the wellbore and a second rotation generated from a mud motor positionable at the bottom hole assembly.

Example 7 is the system of examples 1-6, further comprising: a mud motor positionable to receive a flow of the drilling fluid at a downhole location and to convert the flow of the drilling fluid into a rotation of the bottom hole assembly.

Example 8 is the system of examples 1-7, wherein the decoded downlink signal comprises instructions to set a cruise control of the rotary steerable system, update a toolface setting of the rotary steerable system, update a duty cycle setting of the rotary steerable system, or a combination thereof.

Example 9 is a computer-implemented method comprising: receiving sensor signals from at least one sensor at a bottom hole assembly within a wellbore; identifying at least two downlink signal triggers from the sensor signals; detecting a downlink signal between the at least two downlink signal triggers; decoding the downlink signal detected between the at least two downlink signal triggers; and controlling a downhole tool using the decoded downlink signal.

Example 10 is the method of example 9, wherein controlling the downhole tool comprises steering a drill bit of a rotary steerable system.

Example 11 is the method of examples 9-10, wherein at least one of the at least two downlink signal triggers comprises a rate of change to a flow of drilling fluid, a rate of change of a rotation of the bottom hole assembly, or a combination thereof.

Example 12 is the method of examples 9-11, wherein at least one of the at least two downlink signal triggers comprises an edge detection of a change in a magnitude of a flow of drilling fluid, a rotation of the bottom hole assembly, or a combination thereof.

Example 13 is the method of examples 9-12, wherein a first trigger of the at least two downlink signal triggers comprises a flow rate of drilling fluid exceeding a pumps-on threshold.

Example 14 is the method of example 13, wherein a second trigger of the at least two downlink signal triggers comprises a rotation rate of the bottom hole assembly exceeding a rotation-on threshold.

Example 15 is the method of example 14, wherein the rotation-on threshold is achieved using a combination of a first rotation generated from rotating a drill string at a surface of the wellbore and a second rotation generated from the a mud motor positionable at the bottom hole assembly.

Example 16 is a non-transitory computer-readable medium comprising program code that is executable by a processing device for causing the processing device to: receive sensor signals from at least one sensor at a bottom hole assembly within a wellbore; identify at least two downlink signal triggers from the sensor signals; detect a downlink signal between the at least two downlink signal triggers; decode the downlink signal detected between the at least two downlink signal triggers; and control a downhole tool using the decoded downlink signal.

Example 17 is the non-transitory computer-readable medium of example 16, wherein controlling the downhole tool comprises steering a drill bit of a rotary steerable system.

Example 18 is the non-transitory computer-readable medium of examples 16-17, wherein at least one of the at least two downlink signal triggers comprises a rate of change to a flow of drilling fluid, a rate of change of a rotation of the bottom hole assembly, or a combination thereof.

Example 19 is the non-transitory computer-readable medium of examples 16-18, wherein at least one of the at least two downlink signal triggers comprises an edge detection of a change in a magnitude of a flow of drilling fluid, a rotation of the bottom hole assembly, or a combination thereof.

Example 20 is the non-transitory computer-readable medium of examples 16-19, wherein a first trigger of the at least two downlink signal triggers comprises a flow rate of drilling fluid exceeding a pumps-on threshold, and a second trigger of the at least two downlink signal triggers comprises a rotation rate of the bottom hole assembly exceeding a rotation-on threshold.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

at least one sensor positionable at a bottom hole assembly within a wellbore to detect flow of drilling fluid, a rotation of the bottom hole assembly, or a combination thereof;

a rotary steerable system positionable within the wellbore to steer a drill bit;

a processing device positionable to communicatively couple to the at least one sensor and the rotary steerable system; and a memory device comprising instructions that are executable by the processing device for causing the processing device to:

receive sensor signals from the at least one sensor at the bottom hole assembly within the wellbore;

identify at least two downlink signal triggers from the sensor signals, the at least two downlink signal triggers comprising an edge detection of a change in a magnitude of the flow of drilling fluid, wherein a first downlink signal trigger of the at least two downlink signal triggers comprises a first drilling parameter threshold, wherein a second downlink signal trigger of the at least two downlink signal triggers comprises a second drilling parameter threshold that is the same as the first drilling parameter threshold, wherein the sensor signal comprises a downlink signal that comprises a plurality of concatenated commands, wherein each concatenated command of the plurality of concatenated commands has a length that is based at least in part on a command delay, a code length, and a command value;

decode the downlink signal detected between each of the at least two downlink signal triggers; and control the rotary steerable system to steer the drill bit using the decoded downlink signal.

2. The system of claim 1, wherein at least one of the at least two downlink signal triggers further comprises a rate of change of the rotation of the bottom hole assembly.

3. The system of claim 1, wherein at least one of the at least two downlink signal triggers comprises the rotation of the bottom hole assembly, or a combination of the edge detection and the rotation of the bottom hole assembly.

4. The system of claim 1, wherein a first trigger of the at least two downlink signal triggers comprises a flow rate of the drilling fluid exceeding a pumps-on threshold, and wherein a second trigger of the at least two downlink signal triggers comprises a rotation rate of the bottom hole assembly exceeding a rotation-on threshold.

5. The system of claim 4, wherein the rotation-on threshold is achieved using a combination of a first rotation generated from rotating a drill string at a surface of the wellbore and a second rotation generated from a mud motor positionable at the bottom hole assembly.

6. The system of claim 1, wherein decode the downlink signal detected between each of the at least two downlink signal triggers comprises decoding the downlink signal based on pulse position modulation (PPM) encoding of the downlink signal through varying flow rate, rotary speed, or a combination thereof.

7. The system of claim 1, further comprising:

a mud motor positionable to receive a flow of the drilling fluid at a downhole location and to convert the flow of the drilling fluid into a rotation of the bottom hole assembly.

8. The system of claim 1, wherein the decoded downlink signal comprises instructions to set a cruise control of the rotary steerable system, update a toolface setting of the rotary steerable system, update a duty cycle setting of the rotary steerable system, or a combination thereof.

9. A computer-implemented method comprising:

receiving sensor signals from at least one sensor at a bottom hole assembly within a wellbore;

identifying at least two downlink signal triggers from the sensor signals, the at least two downlink signal triggers comprising an edge detection of a change in a magnitude of flow of drilling fluid, wherein a first downlink signal trigger of the at least two downlink signal triggers comprises a first drilling parameter threshold, wherein a second downlink signal trigger of the at least two downlink signal triggers comprises a second drilling parameter threshold that is the same as the first drilling parameter threshold, wherein the sensor signal comprises a downlink signal that comprises a plurality of concatenated commands, wherein each partial concatenated command of the plurality of concatenated commands has a length that is based at least in part on a command delay, a code length, and a command value;

detecting the downlink signal between the at least two downlink signal triggers;

decoding the downlink signal detected between the at least two downlink signal triggers; and controlling a downhole tool using the decoded downlink signal.

10. The method of claim 9, wherein controlling the downhole tool comprises steering a drill bit of a rotary steerable system.

11. The method of claim 9, wherein at least one of the at least two downlink signal triggers comprises a rate of change to a flow of drilling fluid, a rate of change of a rotation of the bottom hole assembly, or a combination thereof.

12. The method of claim 9, wherein at least one of the at least two downlink signal triggers comprises rotation of the bottom hole assembly, or a combination of the edge detection and the rotation of the bottom hole assembly.

13. The method of claim 9, wherein a first trigger of the at least two downlink signal triggers comprises a flow rate of drilling fluid exceeding a pumps-on threshold.

14. The method of claim 13, wherein a second trigger of the at least two downlink signal triggers comprises a rotation rate of the bottom hole assembly exceeding a rotation-on threshold.

15. The method of claim 14, wherein the rotation-on threshold is achieved using a combination of a first rotation generated from rotating a drill string at a surface of the wellbore and a second rotation generated from a mud motor positionable at the bottom hole assembly.

16. A non-transitory computer-readable medium comprising program code that is executable by a processing device for causing the processing device to:

receive sensor signals from at least one sensor at a bottom hole assembly within a wellbore;

identify at least two downlink signal triggers from the sensor signals, the at least two downlink signal triggers comprising an edge detection of a change in a magnitude of flow of drilling fluid, wherein a first downlink signal trigger of the at least two downlink signal triggers comprises a first drilling parameter threshold, wherein a second downlink signal trigger of the at least two downlink signal triggers comprises a second drilling parameter threshold that is the same as the first drilling parameter threshold, wherein the sensor signal comprises a downlink signal that comprises a plurality of concatenated commands, wherein each concatenated command of the plurality of concatenated commands has a length that is based at least in part on a command delay, a code length, and a command value;

detect the downlink signal between the at least two downlink signal triggers;

decode the downlink signal detected between the at least two downlink signal triggers; and control a downhole tool using the decoded downlink signal.

17. The non-transitory computer-readable medium of claim 16, wherein controlling the downhole tool comprises steering a drill bit of a rotary steerable system.

18. The non-transitory computer-readable medium of claim 16, wherein at least one of the at least two downlink signal triggers comprises a rate of change to a flow of drilling fluid, a rate of change of a rotation of the bottom hole assembly, or a combination thereof.

19. The non-transitory computer-readable medium of claim 16, wherein at least one of the at least two downlink signal triggers comprises rotation of the bottom hole assembly, or a combination of the edge detection and the rotation of the bottom hole assembly.

20. The non-transitory computer-readable medium of claim 16, wherein a first trigger of the at least two downlink signal triggers comprises a flow rate of drilling fluid exceeding a pumps-on threshold, and a second trigger of the at least two downlink signal triggers comprises a rotation rate of the bottom hole assembly exceeding a rotation-on threshold.

* * * * *